United States Patent [19]

Schneider

[11] Patent Number: 4,546,019

[45] Date of Patent: Oct. 8, 1985

[54] WORKS OF VISUAL AND SCULPTURAL ART AND METHODS OF MAKING THEM

[76] Inventor: Donna Schneider, c/o South Seas Specialities, 875 Waimanu St., No. 516, Honolulu, Hi. 96813

[21] Appl. No.: 612,736

[22] Filed: May 21, 1984

[51] Int. Cl.[4] ..... B44C 3/06; B44F 1/04

[52] U.S. Cl. ..... 428/13; 40/160; 40/582; 427/275; 428/542.2; 428/912.2

[58] Field of Search ..... 428/13, 542.2, 912.2; 40/10 D, 160, 582; 427/275

[56] References Cited

U.S. PATENT DOCUMENTS

| | | | |
|---|---|---|---|
| 2,065,406 | 12/1936 | Silverman | 428/13 |
| 2,124,143 | 7/1938 | Long | 428/13 X |
| 4,180,930 | 1/1980 | Di Matteo | 428/13 X |
| 4,262,042 | 4/1981 | Bruskin | 428/13 X |

*Primary Examiner*—Henry F. Epstein

*Attorney, Agent, or Firm*—Robert C. Podwil

[57] ABSTRACT

A work of visual or sculptural art includes an image applied to a transparent substrate. The image is cut on or into the substrate, and is highlighted by a contrast or color-enhancing backing. The work of art and method are appliable to useful articles.

6 Claims, 7 Drawing Figures

FIG. 1
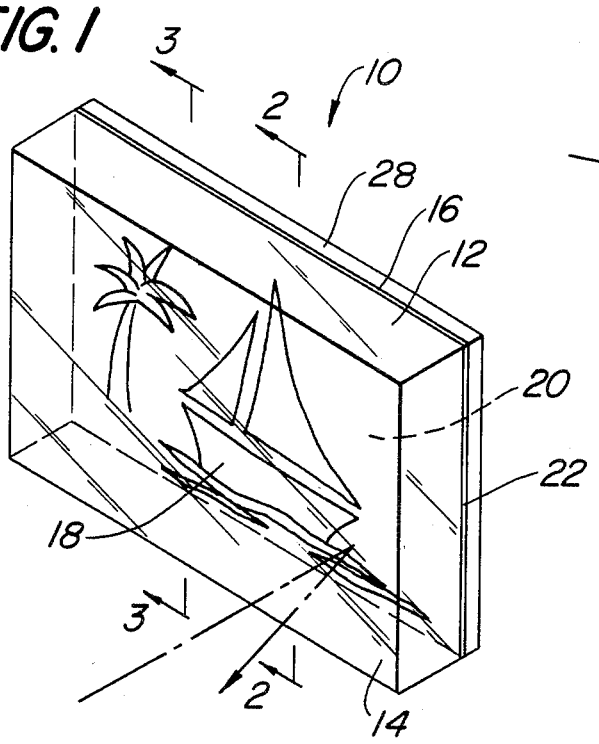
FIG. 2
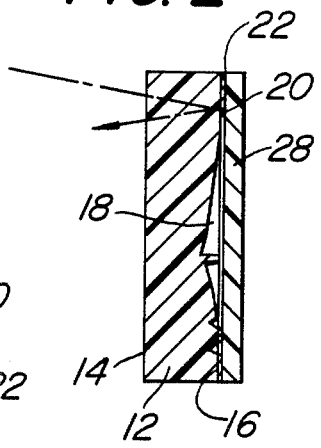
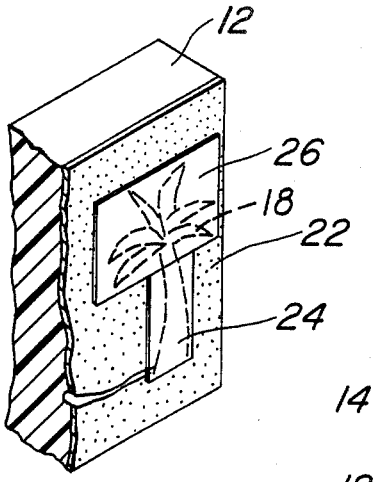
FIG. 3
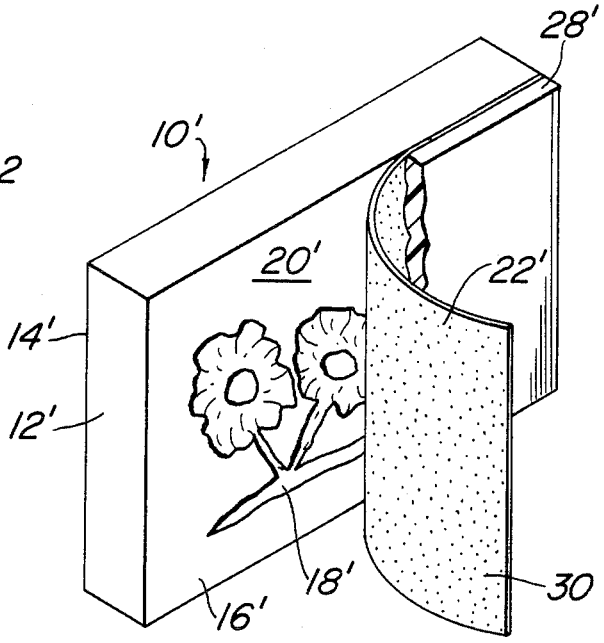
FIG. 4

WORKS OF VISUAL AND SCULPTURAL ART AND METHODS OF MAKING THEM

BACKGROUND OF THE INVENTION

This invention relates to works of visual and sculptural art, and to methods of making them. More particularly, this invention relates to a decorative article, in the nature of "bric-a-brac", which provides an eye-pleasing pictorial or design image, which may contain coloration if desired.

Visual or sculptural images have heretofore been applied to transparent materials such as glass or plastic. Such images may be applied to glass by sand-blasting or chemical etching, or they may be carved into the surface of glass or plastic using grinding or cutting tools. The latter kind of image, which may technically be referred to as an "intaglio" image, is the reverse of a so-called "relief" image (in which the image stands out from a reference surface).

Intaglio and other images in transparent bodies can be quite attractive, but they can also be difficult to perceive due to a lack of contrast between the image and the background material.

It is, accordingly, an object of the present invention to provide a work of visual and sculptural art in which the contrast between an image, such as, for example, intaglio image, and the transparent body on which the image is made, is enhanced, so as to enhance the appearance of the image and the overall work. It is another object of the present invention to provide, in conjunction with an intaglio or other image in a transparent body, attractive and easily applied coloration, to further enhance the appearance of the image and the work.

In another of its aspects, the present invention relates to a method of making a work of visual and sculptural art, the practice of which produces relatively high contrast between an intaglio image and a transparent body in which it is formed.

BRIEF DESCRIPTION OF THE INVENTION

Briefly, in its article aspect, the present invention relates to a work of visual and sculptural art, in which a generally transparent sheet or block-like substrate has an intaglio or other image applied to one of its surfaces. In one form of the invention, the image is applied to the rear surface so as to be visible through the front surface. Contrast between the image and the background is enhanced by providing around the image a colored or light-reflective layer, so directed that incident light reaching the rear surface of the substrate is reflected toward and through the front surface. The effect of the above is to provide an image which has a milky or cloudy appearance, surrounded and set off by a contrasting background. In the case of an intaglio image, the image has a three-dimensional appearance as well. The background, in one embodiment of the invention, is mirror-like and may bridge the image, thus enhancing contrasts within the image but not imparting color to the image. In another alternative, the background comprises white or colored films. Also, colored films may be mounted in desired areas behind the image so as to impart color to portions of the image, thus further enhancing the attractiveness of the image.

In another of its aspects, the present invention involves a method of making a work of art, the method comprising, in general, the steps of providing a substrate having generally planar surfaces, making a flat or an intaglio image in one of the surfaces of the substrate so that the image is visible from the front of the work, and applying to the rear surface a light-reflective layer, so disposed as to reflect incident light toward and through the front surface. The light-reflective layer may be applied to the rear surface of the substrate before making of the image, also in the rear surface. In such a case, the image would be cut through the light-reflective layer.

DESCRIPTION OF DRAWINGS

FIG. 1 is a pictorial view, depicting an embodiment of the invention;

FIG. 2 is a cross-sectional view, taken along the line 1—1 in FIG. 1;

FIG. 3 is a cross-sectional view, taken along the line 3—3 in FIG. 1, and depicting a further detail of the invention; and FIG. 4 is a partial cross-sectional view of an alternative embodiment of the invention.

Figure 5:
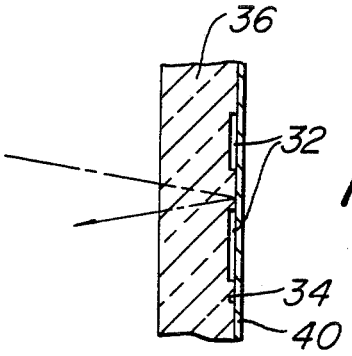
FIG. 5 is a partial cross-sectional view of another alternative embodiment of the invention.

Referring now to the drawings in detail, wherein like reference numerals indicate like elements, the invention will be described in reference to an embodiment in which an intaglio image is applied to a rear surface of the article. There is seen in FIG. 1 a work of visual and sculptural art designated generally by the reference numeral 10. The article 10 is comprised of a generally transparent block-like member or substrate 12, which has front 14 and rear 16 surfaces. In the illustrated form of the article 10, the front and rear surfaces 14, 16 are generally planar and also generally parallel, although other relative orientations of the surfaces 14 and 16 are possible.

The member 12 is preferably made of clear plastic polymeric material, such as the acrylic materials sold under the trademarks "Lucite" or "Plexiglas". Other suitable materials may be used.

Incised (cut or carved) or otherwise fashioned in the rear surface 16 of the member 12 and extending into the member 12 toward the front surface 14 is an intaglio image 18. Viewed from the rear surface 16, the intaglio image 18 is concave, but viewed from the front surface 14, through the member 12, it has the three-dimensional appearance of the kind of sculptural work familiarly known as "relief".

The member or substrate 12 may be made by casting or it may be cut from a cast block of material, but in either case, both the front 14 and rear surfaces 16 have or are finished to a smooth, glass-like finish, and are transparent. The surface of the intaglio image 18, on the other hand, is kept relatively rough, as it would naturally be if the image were formed (as it may be) by drilling, routing and filing, using dental-like tools. As a result, the intaglio image 18, when viewed through the front surface 14 of the member 12, has a cloudy or milky appearance, which enhances the appearance of solidity and depth of the image 18.

A novel aspect of the present invention is the manner in which further contrast is provided between the intaglio image 18 and the surrounding areas of the rear surface 16 which are unaffected by the image 18.

In this regard, referring now to FIGS. 2 and 3, disposed on the rear surface 16 of the member or substrate 12 is a light-reflective layer 22. The light-reflective layer 22 covers at least those portions 20 of the rear surface 16 which are not affected by the intaglio image 18, and is so disposed as to reflect toward the front surface 14.

In one embodiment of the article 10, the light-reflective layer 22 is a layer of silvered paint of the kind used to create conventional mirrors. In this embodiment of the article 10, the light-reflective layer is preferably applied to the rear surface 16 of the member or substrate 12 before creation of the intaglio image 18. Thus, in this embodiment, incision of the intaglio image 18 is done through the light-reflective layer 22, and all of those areas of the layer 22 which are unaffected by the making of the image 18 remain undisturbed.

In practicing the present invention, it is possible to impart to the intaglio image 18 or portions of that image desired colors, in a manner which will now be described.

Referring to FIG. 3, for example, in which a tree is depicted, if it is desired that the trunk of the tree appear brown, a brown backing layer 24 may be applied behind the trunk in the image 18. Similarly, if it is desired that the foliage appear green, a green backing layer 26 may be applied behind the area depicting the foliage. In one presently preferred form of the article 10, the backing layers are colored self-adhesive plastic film, adhesively coupled to the rear surface by applying it to the back of the light-reflective layer 22.

The article 10 may be finished by applying, behind the light-reflective layer, a backing member 28. The backing member 28 may be a sheet or block-like member, preferably somewhat thinner than the member or substrate 12, but without an image carved therein.

Referring now to FIG. 4, there is seen an alternative form of the article, in which elements corresponding to those previously described are identified by like primed reference numerals.

In the embodiment shown in FIG. 4, the light-reflective layer 22' comprises a film of highly reflective material, such as the silver-colored material sold under the trademark "Mylar" or its equivalents. The film, which is designated by the reference numeral 30, may be adhesively applied to the rear surface 16' of the article 10', so as to overlie the entirety of the rear surface 16', including the intaglio image 18'. Provision of a light-reflective backing to the intaglio image, it has been found, enhances the contrast in the image and provides an attractive and generally desirable appearance. The film 30 need not, however, be silver or mirror-like. In other embodiments, the invention may advantageously employ a white or colored film 30, which would impart to the article 10 a somewhat different effect.

Although the above description is made in reference to an embodiment of the invention in which an intaglio image is applied to the rear surface 16 of the member or substrate 12, the principles of the invention can be applied to embodiments using other kinds of images. Thus, referring to FIG. 5, there is seen an embodiment in which an image 32 is cut on the rear surface 34 of a member or substrate 36, in this case a glass substrate, by sand-blasting or mechanical or chemical etching.

Figure 6:
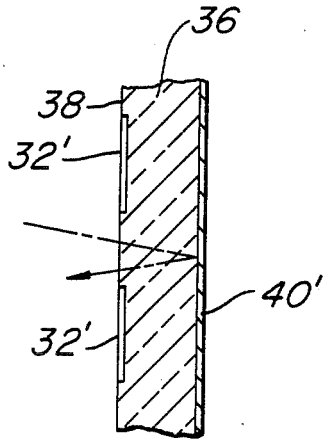
FIG. 6 is a partial cross-sectional view of still another alternative embodiment of the invention.

In FIG. 6, in which elements corresponding to those described in conjunction with FIG. 5 are described by like primed reference numerals, a sand blasted or mechanically or chemically etched image 32' is applied to a front surface 38 of the substrate 36. Viewing through the front surface 38, one sees the image 32 against a background provided by a silver, white or colored backing layer 40.

The above-described techniques for applying color to the intaglio image 18, using colored backing layers (e.g., backing layers 24 and 26), may also be used in conjunction with flat images such as the image 32 in FIG. 5. With a flat image such as the image 32, applied to the rear surface of a substrate, an adhesively applied backing layer 40, like the backing layer 22' in FIG. 4, could be used.

Figure 7:
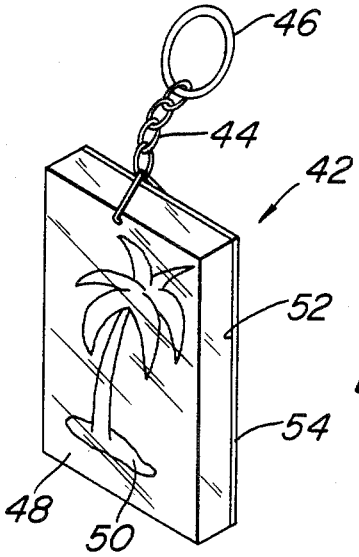
FIG. 7 is an illustration of the principles of the present invention, applied to a useful article such as a key ring.

FIG. 7 illustrates an application of the principles of the present invention to a useful article, namely a key ring 42. The key ring 42 includes a chain 44, attached to a ring 46 and a tag-like body member 48. The body member 48 carries an intaglio image 50, carved into its rear surface 52. A silver, white or colored adhesively applied light-reflective layer 54 is applied to rear surface 52, and covers the image 50. If colored, the layer 54 imparts to the body member 48 the color of the layer with the image 50 appearing somewhat lighter. If "silvered" or white, the layer 54 enhances the contrast between the image 50 and its background, without imparting noticeable color to the image 50 or the background.

In another of its aspects, the present invention relates to a method of making a work of visual and sculptural art. The method comprises the steps of first providing a transparent block-like substrate having front and rear surfaces; making in the rear surface of the substrate an intaglio or flat image in such a manner that the image is visible through the front surface of the substrate; and applying to the rear surface of the substrate a light-reflective layer, so disposed as to reflect incident light toward and through the front surface of the substrate. Application of the light-reflective layer may be accomplished by applying to the rear surface of the substrate a film, or it may be accomplished by "silvering" the rear surface in the manner of the making of a mirror, and cutting the image through the silvered surface. In either event, the light-reflective layer provides a backdrop for the image.

The present invention may be embodied in other specific forms without departing from its spirit or essential attributes. Accordingly, reference should be made to the appended claims rather than the foregoing specification as indicating the scope of the invention.

I claim:

1. A work of visual and sculptural art comprising a generally transparent substrate having front and rear surfaces thereon, an image cut into said rear surface of said substrate and visible upon viewing said front surface, and a light-reflective layer disposed on said rear surface and covering at least those areas of said rear surface not affected by said image, said light-reflective layer being so disposed as to reflect incident light toward and through said front surface, said light-reflective surface being a mirror, and said image being an intaglio image projecting through said mirror and interrupting said light-reflective layer, and means associated with said intaglio image for coloring at least a portion of said image, said means for coloring comprising colored film means coupled to said rear surface and disposed behind the said portion of the intaglio image.

2. An article in accordance with claim 1, wherein said means for coloring comprises a colored self-adhesive film adhesively coupled to said rear surface.

3. An article in accordance with claim 2, and a backing member adjoining and coupled to said rear surface of said substrate.

4. An article in accordance with claim 3, wherein said backing member is transparent.

5. A method of making a work of visual and sculptural art, comprising the steps of providing a generally transparent block-like substrate having front and rear surfaces thereon, applying to the rear surface of the substrate a light-reflective layer so disposed as to reflect incident light toward and through the front surface, and incising through the light-reflective layer and into the substrate an intaglio image, so that the image is visible through the front surface and the light-reflective layer provides a backdrop for the image, and the further step of imparting color to selected areas of said intaglio image by applying to the rear surface of the substrate behind the selected areas colored film means.

6. A method in accordance with claim 5, and the further step of enclosing said light-reflective layer with a backing member.

* * * * *